United States Patent [19]

Chisholm, Jr.

[11] Patent Number: 4,696,392

[45] Date of Patent: Sep. 29, 1987

[54] CAGE ROLL ASSEMBLY

[75] Inventor: Donald P. Chisholm, Jr., Merrimac, N.H.

[73] Assignee: Specialty Equipment Corporation, Worcester, Mass.

[21] Appl. No.: 864,040

[22] Filed: May 16, 1986

[51] Int. Cl.[4] ..... B65G 39/18

[52] U.S. Cl. ..... 198/836; 271/182; 144/246 A; 144/246 E; 144/247; 493/125; 493/144; 493/181; 493/182

[58] Field of Search ..... 198/836; 144/246 R, 144/246 A, 246 E, 247; 493/125, 126, 144, 147, 181, 182; 271/182, 202, 270

[56] References Cited

U.S. PATENT DOCUMENTS

| | | | |
|---|---|---|---|
| 2,584,855 | 2/1952 | Fergnani | 493/182 |
| 2,679,871 | 6/1954 | Ford | 144/247 |
| 2,948,312 | 8/1960 | Rothrock | 144/247 |
| 3,171,450 | 3/1965 | Boullet | 144/247 |
| 3,605,576 | 9/1971 | Shields | 493/144 |
| 4,163,491 | 8/1979 | Rock et al. | 198/836 |
| 4,441,536 | 4/1984 | Rautio | 144/246 A |

FOREIGN PATENT DOCUMENTS

| | | | |
|---|---|---|---|
| 1434430 | 5/1976 | United Kingdom | 198/836 |
| 400466 | 3/1974 | U.S.S.R. | 144/247 |

*Primary Examiner*—Frederick R. Schmidt
*Assistant Examiner*—William E. Terrell
*Attorney, Agent, or Firm*—Robert K. Tendler

[57] ABSTRACT

An anti-toggling, constant-contact cage roll assembly is provided for movement of corrugated box blanks along a belt. In one embodiment, the cage roll assembly includes a series of four rollers that are mounted to a bar spring-biased away from a frame, in which the bar is pivotally mounted at each end to an associated lever arm, each of which is in turn pivotally mounted to the frame to form a modified four-bar linkage, with a compliant mount for one lever arm, the mount for the other lever arm being fixed to the frame to permit limited canting of the roller-carrying bar to accommodate multiple folded layers of corrugated material. The subject cage roll assembly prevents the prior art type of toggling of pairs of rollers into an almost vertical position as the box blank moves between the rollers and the belt and thus prevents jamming. In one embodiment, each of the lever arms carries an adjustable stop at the free end for positioning the bar above the belt which carries the box blank. In another embodiment, compliant rollers are used to aid in constant contact with the box blank. In a further embodiment, lateral flanges prevent flying debris from jamming in between rollers.

14 Claims, 7 Drawing Figures

CAGE ROLL ASSEMBLY

FIELD OF INVENTION

This invention relates to the fabrication of corrugated or other boxes and more particularly to a cage roll to assist in the driving of a corrugated box blank along a given path.

BACKGROUND OF THE INVENTION

It will be appreciated that in manufacturing of boxes, especially thick corrugated boxes which may have folded thicknesses of up to ¾ of an inch, it is important to be able to transport these box blanks through the folding, gluing, or attachment process by a transport means which maintains pressure and contact on the drive belt as the box part or blank moves with the belt. Problems of alignment and jamming occur in general when there is either insufficient pressure to maintain the box blank in frictional contact with the belt; or the rollers that are utilized to produce the top pressure become canted or otherwise inoperative as the box parts are being transported from one location to another. One particular problem with the respect to corrugated boxes as opposed to cardboard boxes is the relatively large range of thickness that have to be accommodated in order to effectuate transport, alignment and other critical parameters.

Prior art transport of corrugated boxes was accomplished in some cases by an over belt or two belt system in which there was an under belt which supported the box blank and an over belt which pressed down against the box blank, with the over belt being pressed to the under belt by springloaded top rolls. However, with the belt-on-belt system, maintainment of alignment and jam free operation is difficult because both belts must be driven. It might be thought that driving the belts simultaneously top and bottom would result in an effective transport of the box blanks. While this may be accomplished with cardboard blanks which are relatively thin, in the case of corrugated board there is belt movement in a direction transverse to the direction of travel which ends up with wave shaped curves in the to belt that in effect changes the speed of the upper belt vis-a-vis the speed of the lower belt. Therefore, in order to accommodate corrugated boxes of substantial thicknesses, adjustments of high complexity are necessitated, if this type of system is to be operated properly.

A further problem with corrugated box manufacture is that the belt-over-belt drive configuration results in belt tracking problems in which one belt affects the tracking of the other belt, with the result that one of the other of the belts comes off their respective drive pulley. In a severe case belts have to be realigned and placed on the respective pulleys as many times as three times a day, thereby cutting down production because the production has to stop in order to realign the belts. Moreover, when a belt is off track it is sometimes destroyed and must be replaced altogether, a costly factor.

As a solution to the belt-on-belt drive problem, non-driven rolls are used in direct contact with the underlying belt and/or the blank carried by the belt. Ths permits a speed differential between the top surface of the box part and the belt to be accommodated due to the non-driven nature of the rollers. Traditionally these wheels are mounted in a top frame in a fixed fashion and the frame is positioned above the belt in such a manner as to accommodate the particular boxes or box blanks to be run. This is a fixed system in which the frame carrying the ridgedly mounted rolls or wheels was adjusted for each box blank with no springloading whatsoever. The obvious problem with a fixed system is that it has to be manually adjusted each time there is a box order change. Another problem with such a fixed system is that while it works properly assuming all the rollers wear the same amount, this turns out not to be the fact such that if some rollers wear more than others then the system loses drive and the blank either folds wrong or jams in the machine, especially single thickness boxes.

In an effort to accommodate different size or thickness corrugated boxes a system was devised utilizing pairs of rollers which were pivotally-mounted and springloaded to a frame so as to be able to accommodate different thicknesses while at the same time providing continuous contact between the box part and the roller such that constant pressure was always applied to the box blank between the belt and the box blank. On regular slotted containers, the above mentioned system works satisfactorily in which only a single fold of material or single thickness of corrugated material is manipulated. But when more complicated box structure are required involving multiple thicknesses of corrugated material, in one situation the rollers would be hit so hard that they would rise up and not recontact the blank until further on down the box blank, leaving a portion of the blank with no continuous contact. Secondly, with the blank passing between the rollers and the belt at some thickness and some speeds results in rollers that cant in an almost vertical position and remain there so that only one of the two rolls ever touches the top surface of the blank. This is not self-correcting in that the pivoted double rollers in some instances remain in that configuration until physically moved back down to a horizontal double roll position. With only one pivot to the frame roll pairs, they can become permanently skewed, thereby causing the box blank and or the belt to track off completely or at least move off the direction of travel sufficient to either cause jamming or other down stream problems.

SUMMARY OF THE INVENTION

In order to alleviate the above mentioned problems, in one embodiment, a series of four wheels are mounted for rotation on a bar which is connected to a frame by virtue of a modified four bar pivot in which one of the mounts to the frame is compliant to allow the bar carrying the wheels to cant slightly with respect to the frame. This accommodates multiple folded corrugated blanks while maintaining constant pressure. Springloaded pivoted levers are attached to the roller carrying assemblies at one end of each lever. Each assembly includes a pivot to an end of the appropriate lever and is attached to the bar at either end of the bar, preferably at a point between a set or pair of rollers. For purposes of the present discussion, the bar in one embodiment carries four rollers which can be considered pairs of rollers although they are all mounted to the bar and rotate about fixed centers on the bar. Moreover, the bar can carry as many wheels or roller as desired. Thus the bar is mounted to the frame at two positions.

Secondly, with the leading mount or pivot being fixed and the second of the mounts being resilient, the subject cage roll accommodates multiple thicknesses of corrugated blanks while still maintaining continuous contact with the top surface of the topmost folded portion of the blank. The entire bar is springloaded at two points in a downward direction so as to maintain the appropriate pressure on the blank as it moves along the belt. Excessive canting of the entire bar assembly is prevented by the four bar pivot system while at the same time maintaining the ability to provide pressure along the entire surface of the blank as it travels through the cage roll assembly. Thus when the relatively thick blank is presented to the leading roller of the cage roll, the cage roll bar moves upwardly at its front end against springloading such that it self-adjusts to the leading edge of the blank being passed thereunder. The second of the rollers then contacts the surface of the blank after the bar has been originally canted slightly upwardly to accommodate the thickness of the blank being passed thereunder. There is a downward pressure exerted between the firt two rollers by virtue of a spring load in one embodiment, although the point of application of pressure at the leading portion of the bar is not critical. The blank then contacts the third roller which then causes the aft end of the bar to rise against a spring loaded pressure exerted at the aft end of the bar. In one embodiment neither of the two aft rollers lift off the blank because of the resiliency of the second mount.

It will be appreciated that this is different from a simple four bar linkage in which opposite ends of the bar would be lifted equally if both mounting points were fixed. Thus, for a fixed four bar system, however high the front roller is lifted, the entire bar strays parallel to the frame. Therefore, the four rollers mounted to the bar would be raised to the height of the initial roller as the box blank comes through. One of the problems with this type system is that the cage roll mass is being lifted by one roller namely the first roller. This causes such forces that the initial roller actually tends to stop forward motion of the blank which may either damage the blank, cause jamming or cause the blank to slip on the underlying belt. The second problem with such a rigid four-bar mounting system is that were the box to be thick at the leading edge and thin at the trailing edge of the blank then the initial contact with the leading roller would raise the cage roll assembly to the initial increased thickness portion and maintain it there, with the result that the trailing thinner box blank portion would not have constant contact pressure being applied to it due to the raising of the entire bar structure with the initial contact with the leading edge of the box blank. This is a particularly important problem when, as mentioned hereinbefore, corrugated materials are double, triple and quadruple folded.

The above mentioned problems are solved by the subject invention due to the compliancy of the aft mount which at the very least allows the entire bar to cant, but not sufficiently to cant into a position where it will not fall back to its original position, thereby to accommodate at least front to back differences in thickness of the corrugated folded board passing between it and the belt.

As part of the subject invention, while the resiliency of the four bar structure having a resilient mount at the aft end permits the bar to assume a non-parallel position with respect to the frame as the box blank runs through, the resiliency of the rollers themselves provide another measure of constant pressure as follows.

Taking for example a first roller contacting a folded structure which may have as many as three folds of corrugated material, the roller itself may tend to flatten out at its bottom portion in order to accommodate the passage of the triple-folded blank at that position. The second roller on the other hand may distort into local indentations or flat spots to provide a certain amount of pressure after the initial roller; whereas the third roller will in general be slightly less distorted. In this situation the final roller will be minimally compressed. This adds to the maintenance of a constant pressure on the blank, at all times.

Thus, as part of the subject invention, not only is there a cage roll system which is double pivoted with a fixed and resilient mount, there is also the aspect of utilizing resilient rollers which are mounted to the bar in order to facilitate the necessary continuous contact with the blank as it goes through.

A further feature of the subject invention is that with the lever pivotally mounted, the free ends of the levers are provided with adjustable stops such that the entire bar structure may be maintained a certain distance above the belt. This minimizes belt wear when there are no blanks being passed through that particular section. Secondly, the closer that the bar can be maintained to the actual thickness of the blank going through, the less wear which is engendered. Alternatively, the stops may be adjusted so that the bar and rollers mounted thereon exert a pressure on the underlying belt if such is desired.

Moreover, because the rollers are mounted to a bar, the bar acts as a guide to prevent a warped corrugated board from projecting up into the spaces between the rollers which can cause jam ups. In contradistinction to prior configurations utilizing single fixed rollers or springloaded pairs of wheels mounted to the frame, this is prevented in the subject invention by a separate bar having a lower edge which serves as a guide such that corrugated board warpage does not result in machine jam up. A further feature of subject invention is therefore that the bar itself which resembles a ski prevents warped board from projecting up into the space between the rollers in each individual cage assembly, thereby permitting the use of non-perfectly flat corrugated board or warped board without fear of interruptions in production.

With respect to utilizing cage rolls after a die-cutter, it will be appreciated that during die-cutting process particles of material literally fly around and are in the area of the cage roll assembly. If these pieces end up between any of the pairs of rollers, the rollers immediately jam and stop, causing scoring, misalignment, and in general catastrophic failure for the box parts going through. For the fore and aft pairs of rollers, horizontal flanges are provided to prevent such flying material from entering into the area between the rollers and the pivot mount, thereby preventing this problem. This type of protection is only necessary at the pivot mount to the bar or where the rollers are adjacent a casting protrusion. It will be appreciated that since the rollers are sufficiently spaced apart, one from the other, the flying cardboard entering the space between the two pairs of rollers is ejected without causing mechanical failure since there is no mechanical structure between the pairs of rollers.

One of the more subtle aspects of the subject system is that when one end is moved upwardly in a rapid fashion the other end of the bar is driven downwardly such that when one part, the part being raised, is tending to reduce the drive, the other part or end of the structure tends to increase pressure therefore increasing the drive to cancel out the effect. Thus the subject system provides an excellent uniform drive pressure over the entire portion of the box blank.

As an alternative embodiment, rollers can also be mounted to the other side of the bar for wider belts, or the entire cage roll assembly can be duplicated in the transverse belt direction for even wider or more extensive contact across the box blank. Alternatively, two assemblies can be mounted side-by-side, preferably in an offset manner. The above-mentioned offsetting refers to offsetting the bars or rollers in that the ouer set of the bars is moved rear-wardly, for instance, by one or more roller spacings with respect to the corresponding cage roll it is adjacent to. Thus, while one cage roll may be moved rapidly upwardly, the offset prevents coupling of this to the second cage roll assembly so that it operates independently to provide independent pressure and coverage.

In summary, an anti-toggling, constant pressure cage roll assembly is provided with, in one embodiment, a series of four rollers that are mounted for rotation to a bar, with each end of the bar mounted to an assembly which is pivotally mounted at one end of a lever arm which is in turn pivotally mounted at an intermediate point along the lever arm to a frame to form a modified four-bar linkage, with a compliant mount for one linkage, the other mount being fixed to the frame. Note, the frame is one link of the four bar system. Both ends of the roller-carrying assembly are springloaded to the frame, with the pivot for the downstream assembly being mounted to the frame with the compliant mount to permit canting of the bar with respect to the frame. Alternatively, this may be reversed. Each of the lever arms carries adjustable stop means at its free end for positioning the bar above the belt which carries the box blank, if desired. The subject cage roll assembly prevents the prior art type of toggling of pairs of rollers into an almost vertical position as the box blank moves between the rollers and the belt and thus prevents jamming. Other features include compliant rollers and means for preventing jamming by flying debris.

BRIEF DESCRIPTION OF THE DRAWINGS

These and other features of the Subject Invention will be better understood in connection with the Detailed Description taken in conjunction with the Drawings of which.

DETAILED DESCRIPTION

Figure 1:
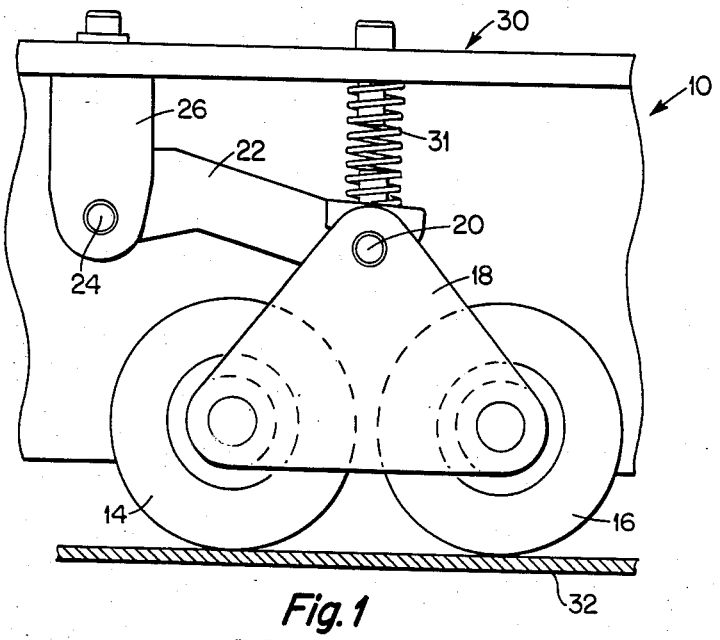
Fig. 1 PRIOR ART
FIG. 1 is a side and diagrammatic view of a prior art two roller system utilized to pressure a box blank against a belt.

Referring to FIG. 1, a prior art cage roll assembly 10 includes a pair of rollers or wheels 14 and 16 mounted to a pivoted assembly 18, which is mounted for rotation about a point 20 on one end of a lever arm 22 which is pivotally secured at its other end to a mount 26. Mount 26 is fixedly attached to a frame 30, with pivot point 20 being urged in a downward direction via spring biasing means 31 so as to urge rollers 14 and 16 into frictional contact with a moving belt generally indicated by reference character 32.

Figure 2:
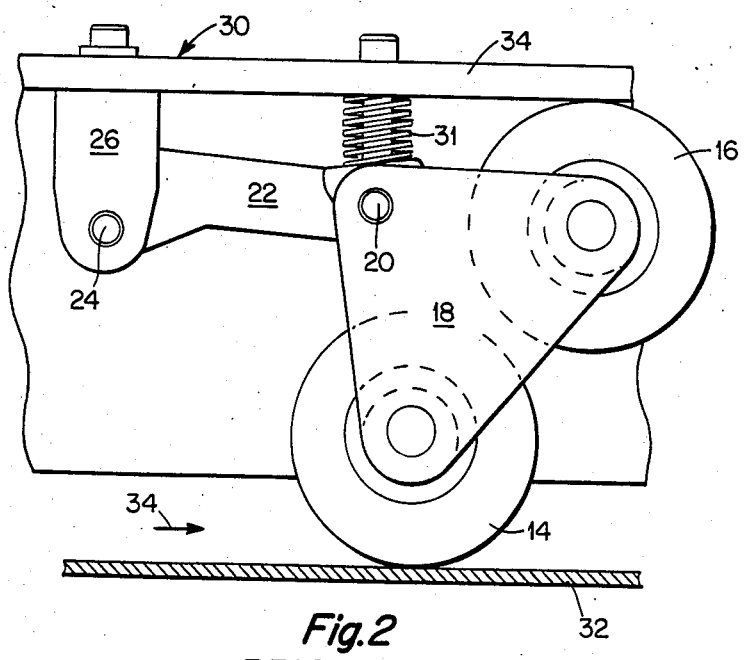
Fig. 2 PRIOR ART
FIG. 2 is a side and diagrammatic view of the roller system of FIG. 1 in which the double roller of FIG. 1 is canted permanently with respect to the belt, thereby applying only one roller's worth of pressure to the belt.

When corrugated box blanks are moved through the assembly in the direction of arrow 34 as illustrated in FIG. 2, it will be seen that assembly 18 can become cocked or canted in a near vertical position such that only roller 14 contacts belt 32; whereas roller 16 is jammed against frame lip 34 where it remains until physically moved down to assume the position shown in FIG. 1.

It will be appreciated that this type of cage roll assembly can thus result in jamming or box blanks traveling off of the belt, as well as damage incurred due to the inordinate pressure of one wheel pressing against the box blank. The problem is particularly severe with respect to corrugated materials due to the thicknesses of the corrugated folds which in the aggregate can be as much as three-quarters of an inch above the belt surface. The problems of such a cage roll assembly have been detailed before and they are solved in the present invention, in one embodiment, through the utilization of a modified four-bar linkage which is illustrated in FIG. 3.

Figure 3:
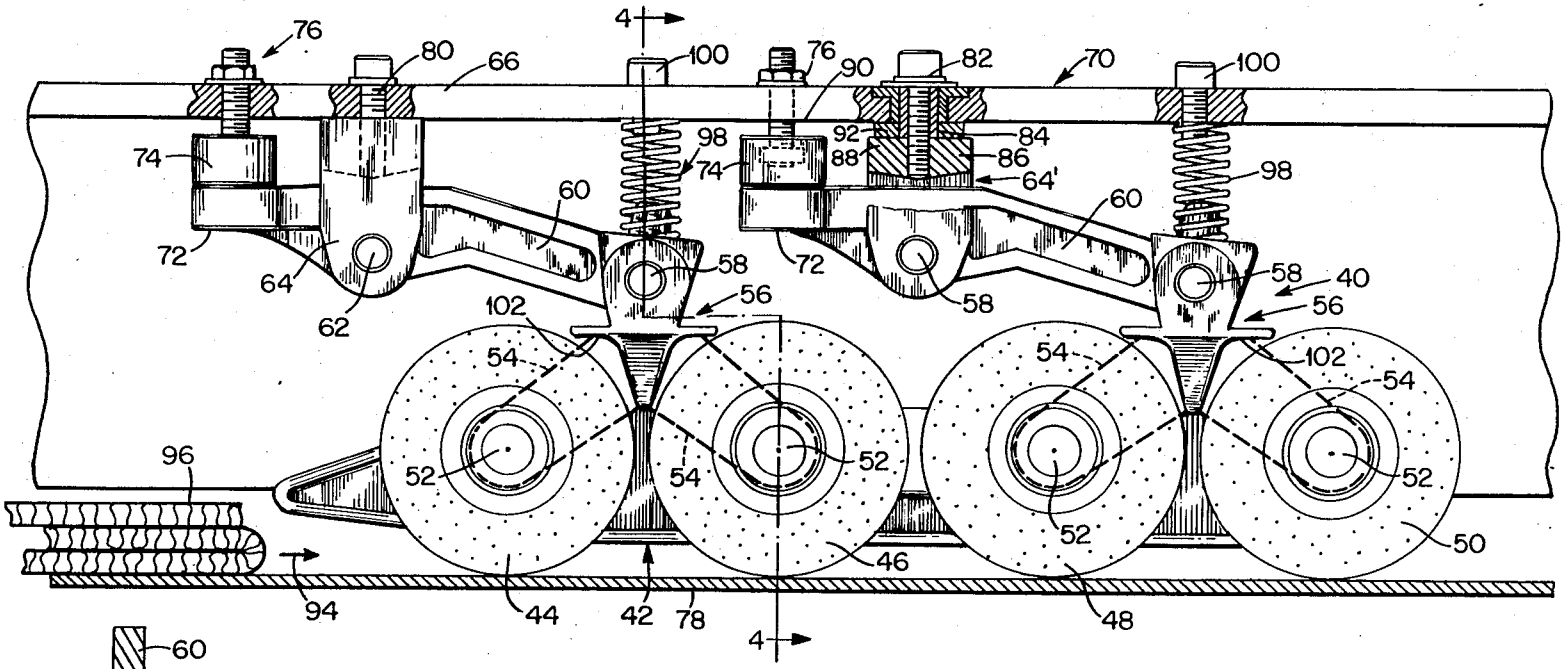
FIG. 3 is a diagrammatic and cross-sectional view of the subject cage roll assembly in which the assembly includes, in one embodiment, two pairs of rollers coupled to a pivoted lever arm while fixedly mounted to a bar in a modified four-bar linkage system.

Referring now to FIG. 3, a modified four-bar linkage 40 includes a bar 42 on which are mounted rollers or wheels 44, 46, 48 and 50. The centers 52 of each of the rollers are attached to an integral bar strut 54 which extends down from an assembly generally indicated by reference character 56 to be pivoted at 58 to the end of a lever 60 which is pivoted at 62 to a mount, either 64 or 64', with mount 64 being fixedly attached to a lip 66 of a frame generally indicated by reference character 70.

The free end 72 of each lever arm abuts a stop 74 which is adjustable via nut and bolt structure 76 so as to initially adjust the height of bar 42 above belt 78.

Mount 64 is fixedly attached to frame 70 via bolt 80 a illustrated; whereas, mount 64' is resiliently mounted to frame 70 via bolt 82 which projects through a rigid sleeve 84 into the body 86 of mount 64'. Interposed between the top surface 88 of mount 64' and bottom surface 90 of lip 66 is a resilient member generally indicated by reference character 92 which supplies a certain amount of compliancy to mount 64', which in this embodiment is the aft or downstream mount vis-a-vis the direction of travel indicated by arrow 94 of folded box blank 96. Alternatively, the front or upstream mount may be resiliently mounted to the frame.

It will be appreciated that the roller pair assembly pivot points 58 are spring biased in a downwardly direction via spring biasing means generally indicated at 98, with bolt 100 providing a guide for the spring.

Note that the roller pair assemblies 56 are provided with a horizontal flange member 102, the purpose of which is to prevent flying debris from entering between the roller pairs as will be discussed hereinafter.

As will be seen, bar 78 is provided with a tapered nose portion 110 which accommodates the introduction of box blanks into the cage roll assembly.

Figure 4:
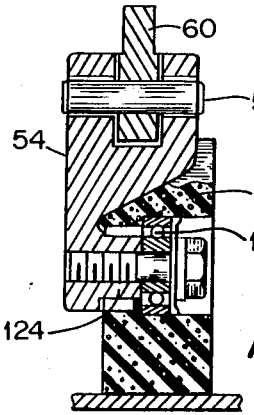
FIG. 4 is a cross-sectional diagram taken along the sectional line 3—3 indicating the attachment of a resilient roller to the pivot assembly which lies intermediate the roller pair.

Referring now to FIG. 4, a cross-sectional view taken along lines 3—3 of FIG. 3 indicates resilient material 120 for a roller which is carried on a roller bearing assembly 122 coupled to a hub 124 which is part of arm 54 that eventually is pivoted at point 58 to lever 60.

In operation, and referring back to FIG. 3, it will be appreciated that stop 74 maintains the bar 42 and thus the rollers at a pre-determined height above belt 78 or in frictional contact therewith. The reason for the stops is so that the cage roll assembly can be raised slightly above the belt to minimize wear when no box blanks are proceeding through this portion of the cage roll assembly.

Figure 5:
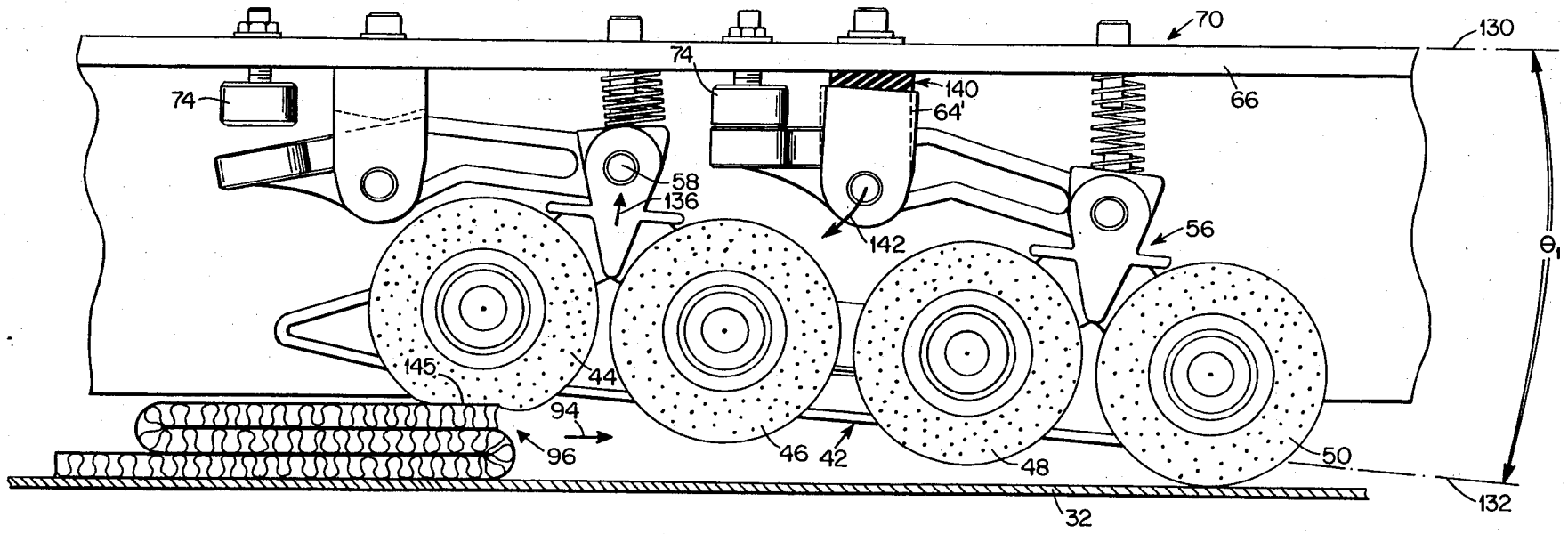
FIG. 5 is a side and cross-sectional view of the operation of the cage roll assembly at FIG. 3, indicating the initial introduction of a multi-folded corrugated box blank into the initial roller of the cage roll assembly, also indicating the canting of the bar with respect to the frame due to the utilization of a compliant mount for the aft lever arm.

In operation, and referring now to FIG. 5, it will be appreciated that the purpose of the modified four-bar assembly is to permit the bar and the wheels that are rotationally mounted thereon to cant with respect to the frame, whereas in a fixed four-bar assembly, the bar and the wheels would rise in parallel to the frame lip upon the introduction of a box blank. Since the subject system is used primarily with corrugated materials which are folded and have substantial thickness, it is therefore important that the bar be able to cant as illustrated by the angle $\theta_1$ between lines 130 and 132 of FIG. 5. In this case, note that bar 42 is not parallel to lip 66 of frame 70 but rather, as described hereinbefore is pushed upwardly by the introduction of the folded box blank 96 as it impinges upon roller or wheel 44. At this point it is important to note that assembly 58 associated with wheel 44 moves upwardly as illustrated by arrow 136; whereas assembly 56, the aft assembly associated with wheels or rollers 48 and 50, moves downwardly. The downward movement is permitted via the compliant coupling, here illustrated diagrammatically at 140 which permits mount 64' to move off the vertical and cant with respect to the frame so that it moves in the direction illustrated by arrow 142. Since initially both levers were positioned in accordance with stops 74, the canting of bar 42 is therefore permitted by the compliancy of the aft mount to the frame. Note also that compliant roller 44 is deformed initially as illustrated at 145 where it slightly flattens out to minimize shock to both the blank and the linkage.

As mentioned hereinbefore, the abrupt movement of the cage roll assembly into the canted position does not result in a permanently canted structure such that no jamming occurs while pressure is at least initially applied to the box blank as it moves along belt 32, again in the direction or arrow 94.

Figure 6:
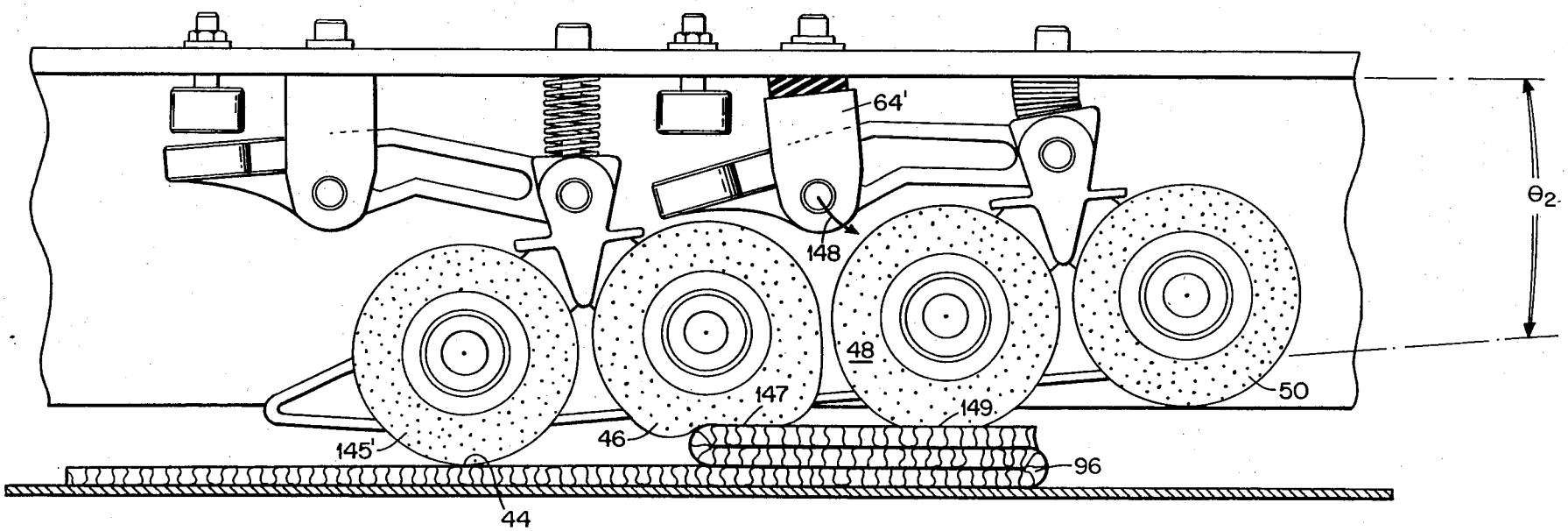
FIG. 6 is a side and cross-sectional view of the cage roll assembly of FIG. 3 indicating the passage of the box blank of FIG. 5 to the center of the assembly, indicating the constant pressure being applied by selected rollers of the cage roll assembly.

Referring now to FIG. 6, as box blank 96 moves into the central region of the cage roll assembly, it is contacted with constant pressure via rollers 46 and 48, in which case the bar moves in the opposite direction so it is canted at angle $\theta_2$. This is permitted by the movement of mount 64' as illustrated by arrow 148. The constant pressure on the box blank can readily be seen in this diagram by the flattening of roller 46 at 147 and the rounding out of roller 44 at 145'. Note roller 48 is also flattened as it contacts the top surface of the blank at 149.

Figure 7:
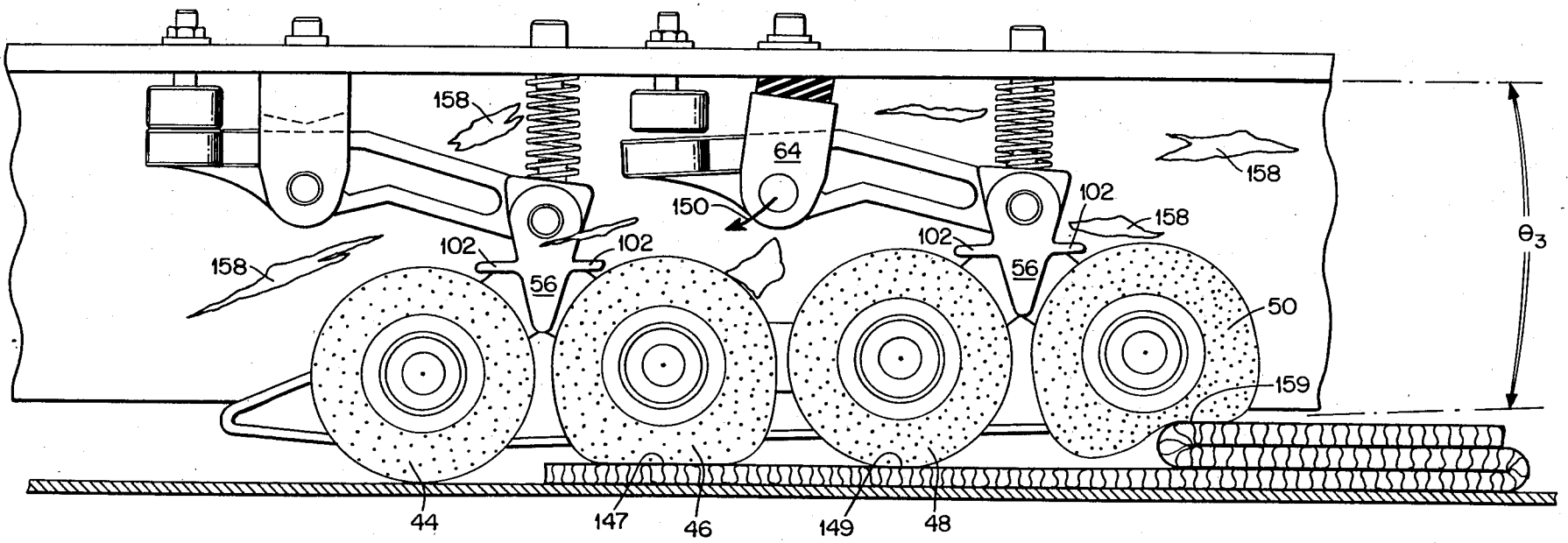
FIG. 7 is a side and cross-sectional view of the cage roll assembly of FIG. 3, illustrating the passage of the box blank under the last of the rollers of the cage roll assembly indicating the pressure which remains on the blank as provided by the last of the rollers of the cage roll assembly.

Referring now to FIG. 7, box blank 96 has moved into the vicinity of roller 50 which again applies pressure, with mount 64' again moving as permitted by the resilient means generally indicated at 140 and arrow 150 so that the entire bar 42 is now canted in its most downward position as illustrated at $\theta_3$, such that wheel 44 contacts belt 78. Here roller 46 is slightly flattened at 147' to contact the remainder of the blank passing through, whereas roller 48 is rather rounded in its contact with the box blank. Roller 50 is now flattened at area 151.

What can be seen is that relatively constant pressure is provided at least by the front and back rollers, if not by the intermediate rolls, in this exaggerated view of the movement of a box blank through the cage roll assembly. Thus, all rollers being compliant do indeed provide pressure against the box blank as described hereinbefore because of the deformed shape which they can take. Thus, a constant pressure is applied by all contacting rollers against the box blank regardless of its thickness.

The resilient material of the rollers is neoprene foam or foam rubber, with or without an outer compliant circumferential band such that the aforementioned compliance permits constant contact of all rollers with portions of the box blank. Thus the rollers, in addition to the ability of bar 42 to cant, permit the relatively constant pressure to be applied, such that the box blank does not jam or run off axis.

As can be seen in FIG. 7, were pieces of material such as from a die-cutting operation to come into contact with, or be in the vicinity of, pivoted roll assemblies 56, these pieces generally indicated at 158 are prevented by horizontal flange 102 from entering into the space between the adjacent rollers in a pair, whereas the space between adjacent pairs of rollers having no casting projection thereat is sufficient to throw off any die-cut or other debris, thereby preventing the aforementioned jamming.

Having above indicated a preferred embodiment of the present invention, it will occur to those skilled in the art that modifications and alternatives can be practiced within the spirit of the invention. It is accodingly intended to define the scope of the invention only as indicated in the following claims.

I claim:

1. In a conveyor having a belt adapted to move in a predetermined direction, an anti-toggling continuous contact cage roll asembly for use in the transportation of corrugated blanks along said moving belt comprising:

a modified four-bar linkage system extending fore and aft relative to the direction of movement of said belt, said linkage system including two linkage arms, a frame, and a bar linked to said frame by said linkage arms, with one end of each arm pivotally mounted to respective fore and aft ends of said bar and with the other end of each arm pivotally mounted to said frame respectively in fore and aft frame mounts, with one frame mount having compliant means to permit the associated arm pivot to move, thereby to permit canting of said bar with respect to said frame;

a number of rollers mounted for rotation to said bar; and, means for urging said bar away from said frame.

2. The assembly of claim 1 wherein said rollers are resilient.

3. The assembly of claim 1 wherein said arms include stop receiving means and further including stop means mounted to said frame to contact said stop receiving means for initially positioning said bar relative to said belt.

4. The assembly of claim 3 wherein said stop means are adjustable to adjust initial bar height.

5. The assembly of claim 1 wherein selected pairs of rollers have an assembly portion projecting there between, and further including flanges mounted to said assembly portion and projecting towards each roller of the pair for preventing debris from getting caught between the rollers of the pair.

6. The assembly of claim 1 wherein said aft frame mount pivot is the compliantly mounted pivot.

7. The assembly of claim 1 wherein said forward frame mount pivot is the compliantly mounted pivot.

8. The assembly of claim 1 wherein said bar has a tapered forward portion to permit entry of box blanks.

9. The assembly of claim 1 wherein said bar has opposite sides running in the direction of said belt and further including rollers on both sides of said bar.

10. A conveyor ncluding a moving belt and at least two anti-toggling continuous contact cage roll assemblies for use in the transportation of corrugated blanks along said moving belt, each cage roll assembly including:

a modified four-bar linkage system extending fore and aft relative to the direction of said belt, said linkage system including two linkage arms, a frame, and a bar linked to said frame by said linkage arms, with one end of each linkage arm pivotally mounted to respective fore and aft ends of said bar and with the other end of each arm pivotally mounted to said frame respectively in fore and aft mounts, with one frame mount having compliant means to permit the associated arm pivot to move, thereby to permit canting of said bar with respect to said frame;

a number of rollers mounted for rotation to said bar; and, means for urging said bar away from said frame, one of said assemblies being mounted parallel to and adjacent the other of said assemblies to provide a combined assembly.

11. The conveyor of claim 10 wherein said assemblies are offset one from the other in a direction substantially parallel to the direction of travel of said belt.

12. A method of providing a continuous pressure to a substantially flat article moving along a belt moving in a predetermined direction comprising:

locating a modified four-bar cage roll assembly above said belt and extending fore and aft relative to the direction of belt movement, said assembly having as one element a frame and having fore and aft linkage arms pivoted at one end to the frame at mounts, with one mount being fixed to the frame and the other mount being compliantly mounted to the frame, and with the other ends of the arms being pivotally coupled to a bar having rollers mounted thereto; and, spring loading the bar toward the belt, with the compliancy of said one mount permitting canting of the bar with respect to the frame.

13. The method of claim 12 wherein said rollers are compliant.

14. The method of claim 12 wherein said locating step includes initially spacing bar above the belt to improve belt wear.

* * * * *